US008674912B2

(12) United States Patent
Nakamura et al.

(10) Patent No.: US 8,674,912 B2
(45) Date of Patent: Mar. 18, 2014

(54) IMAGE DISPLAY DEVICE

(75) Inventors: Norihiro Nakamura, Mobara (JP); Masahisa Tsukahara, Fujisawa (JP); Hajime Akimoto, Kokubunji (JP); Naruhiko Kasai, Yokohama (JP); Takahiro Ichikawa, Mobara (JP)

(73) Assignees: Japan Displau Inc., Tokyo (JP); Canon Kabushiki Kaisha, Tokyo (JP)

( * ) Notice: Subject to any disclaimer, the term of this patent is extended or adjusted under 35 U.S.C. 154(b) by 153 days.

(21) Appl. No.: 12/836,699

(22) Filed: Jul. 15, 2010

(65) Prior Publication Data

US 2011/0012817 A1 Jan. 20, 2011

(30) Foreign Application Priority Data

Jul. 17, 2009 (JP) ..... 2009-168461

(51) Int. Cl.
*G09G 3/30* (2006.01)

(52) U.S. Cl.
USPC ..... 345/80

(58) Field of Classification Search
USPC ..... 345/80
See application file for complete search history.

(56) References Cited

U.S. PATENT DOCUMENTS

| | | | | |
|---|---|---|---|---|
| 6,169,532 | B1 * | 1/2001 | Sumi et al. | 345/98 |
| 2003/0043131 | A1 * | 3/2003 | Iguchi | 345/204 |
| 2003/0067424 | A1 * | 4/2003 | Akimoto et al. | 345/55 |
| 2004/0041750 | A1 * | 3/2004 | Abe | 345/76 |
| 2004/0140968 | A1 | 7/2004 | Kasai et al. | |
| 2004/0179005 | A1 | 9/2004 | Jo | |
| 2005/0007316 | A1 * | 1/2005 | Akimoto et al. | 345/76 |
| 2005/0052377 | A1 * | 3/2005 | Hsueh | 345/82 |
| 2005/0140609 | A1 * | 6/2005 | Akimoto et al. | 345/76 |
| 2005/0285829 | A1 * | 12/2005 | Akimoto et al. | 345/76 |
| 2006/0082525 | A1 * | 4/2006 | Suzuki et al. | 345/77 |
| 2006/0164359 | A1 * | 7/2006 | Kimura | 345/92 |
| 2006/0208977 | A1 * | 9/2006 | Kimura | 345/76 |
| 2006/0226788 | A1 * | 10/2006 | Ogawa | 315/169.3 |
| 2007/0018078 | A1 | 1/2007 | Miyazawa | |
| 2007/0040104 | A1 | 2/2007 | Miyazawa | |
| 2009/0051674 | A1 * | 2/2009 | Kimura et al. | 345/204 |
| 2009/0261446 | A1 * | 10/2009 | Gogoi | 257/500 |
| 2010/0073267 | A1 * | 3/2010 | Akimoto et al. | 345/76 |

FOREIGN PATENT DOCUMENTS

| | | |
|---|---|---|
| JP | 2004-157250 | 6/2004 |
| JP | 2004-252104 | 9/2004 |
| JP | 2007-65539 | 3/2007 |
| JP | 2008-122497 | 5/2008 |
| JP | 2009-086253 | 4/2009 |

* cited by examiner

*Primary Examiner* — Dorothy Harris
(74) *Attorney, Agent, or Firm* — Antonelli, Terry, Stout & Kraus, LLP.

(57) ABSTRACT

An image display device includes: a first power supply line; a second power supply line; a plurality of pixel circuit; a driving circuit for supplying a data signal and a scanning signal; and a switch unit. Each pixel circuit includes: a driving transistor between the first power supply line and the second power supply line; a light emitting element controlled by the driving transistor; and a storage capacitor for storing the data signal and controlling the driving transistor. The driving circuit causes the storage capacitor to store the data signal and controls an intensity of light emission based on the data signal. The switch unit is provided at one of one end of the first power supply line and one end of the second power supply line to control whether or not to allow a current to flow from the first power supply line to the second power supply line.

9 Claims, 14 Drawing Sheets

IMAGE DISPLAY DEVICE

CROSS-REFERENCE TO RELATED APPLICATION

The present application claims priority from Japanese application JP 2009-168461 filed on Jul. 17, 2009, the content of which is hereby incorporated by reference into this application.

BACKGROUND OF THE INVENTION

1. Field of the Invention

The present invention relates to an image display device using light emitting elements.

2. Description of the Related Art

In recent years, image display devices using light emitting elements such as organic electro-luminescence elements (hereinafter, referred to as organic EL elements) are actively developed. When the light emitting elements are used and pixel circuits are arranged in matrix to form an image display device, a display luminance fluctuates among pixels due to fluctuations among driving transistors in the pixel circuits or the like. In order to improve display quality, a circuit for compensating the fluctuations or the like in the pixel circuits is provided. Each of the pixel circuits includes a lighting control switch for controlling lighting of each of the light emitting elements, a pre-charge/reset switch for removing electric charges stored in a storage capacitor or the like in the pixel circuit in which a data signal is written, and the like.

Japanese Patent Application Laid-open No. 2004-157250 discloses a configuration of the above-mentioned pixel circuits. Japanese Patent Application Laid-open No. 2008-122497 discloses an invention which is related to the present invention and involves applying a power supply pulse in an image display device in which writing of data signals and light emission are performed at different timings for each row.

However, there has been a problem in that, when the lighting control switch, the pre-charge/reset switch, and the like are provided in each of the pixel circuits, the configuration of the pixel circuits becomes complicated. This problem leads to, for example, an increase in the number of production steps, reduction in opening ratio of the pixel circuits, and the like.

SUMMARY OF THE INVENTION

The present invention has been made in view of the above-mentioned problem, and an object of the present invention is therefore to provide an image display device in which a configuration of pixel circuits is simplified.

Representative aspects of the invention disclosed in this application are briefly outlined as follows.

(1) An image display device including: a first power supply line; a second power supply line; a plurality of pixel circuit groups each including at least one pixel circuit; a driving circuit for supplying a data signal and a scanning signal to each pixel circuit; and a switch unit, the each pixel circuit including: a driving transistor provided between the first power supply line and the second power supply line; a light emitting element for emitting light in response to a current supplied from the driving transistor; and a storage capacitor for storing a potential difference between a potential corresponding to the data signal, which is supplied to one end thereof, and a potential supplied to another end thereof, in which: the driving circuit selects one of the pixel circuit groups to cause the storage capacitor included in each pixel circuit included in the selected one of the pixel circuit groups to store the potential difference; the driving circuit causes the light emitting element included in the each pixel circuit to emit light of an intensity corresponding to the potential difference in a light emission period that is different from a period in which the one of the pixel circuit groups is selected; and the switch unit is provided at one of one end of the first power supply line and one end of the second power supply line to control whether or not to allow a current to flow from the first power supply line to the second power supply line.

(2) The image display device according to item (1), in which: the switch unit is provided at the one end of the first power supply line; the switch unit selectively supplies the first power supply line with one of a power supply potential and a predetermined potential different from the power supply potential; the second power supply line is supplied with a reference potential at least in the light emission period; and the driving circuit uses the predetermined potential to set electric charges stored in a capacitor of the light emitting element to a predetermined reference state.

(3) The image display device according to item (2), in which the predetermined potential is the reference potential.

(4) The image display device according to item (2) or (3), in which: the each pixel circuit further includes: a reset switch provided between a gate electrode of the driving transistor and a drain electrode of the driving transistor; and a lighting control switch provided between one end of the light emitting element and the drain electrode of the driving transistor; the driving transistor includes a source electrode connected to the first power supply line; the one end of the storage capacitor is connected to the driving circuit; the light emitting element includes another end connected to the second power supply line; and the another end of the storage capacitor is connected to the gate electrode of the driving transistor.

(5) The image display device according to item (2) or (3), further including a lighting control unit that is provided at the one end of the second power supply line and controls the supply of the reference potential to the second power supply line.

(6) The image display device according to item (5), in which: the each pixel circuit further includes a reset switch provided between a gate electrode of the driving transistor and a drain electrode of the driving transistor; the driving transistor includes a source electrode connected to the first power supply line; the light emitting element includes one end connected to the drain electrode of the driving transistor; the one end of the storage capacitor is connected to the driving circuit; the light emitting element includes another end connected to the second power supply line; and the another end of the storage capacitor is connected to the gate electrode of the driving transistor.

(7) The image display device according to item (1), in which: the switch unit is provided at the one end of the second power supply line and controls supply of a reference potential to the second power supply line; and the first power supply line is supplied with a power supply potential.

(8) The image display device according to item (7), in which: the driving transistor includes a source electrode connected to the first power supply line; the light emitting element includes one end connected to a drain electrode of the driving transistor; the one end of the storage capacitor is connected to the driving circuit; the light emitting element includes another end connected to the second power supply line; and the another end of the storage capacitor is connected to a gate electrode of the driving transistor.

According to the present invention, the image display device in which the configuration of the pixel circuits is simplified may be provided.

DETAILED DESCRIPTION OF THE INVENTION

Hereinafter, examples of embodiments of the present invention are described in detail with reference to the accompanying drawings. In the following, examples in which the present invention is applied to a display using organic electroluminescence (EL) elements, which are a type of light emitting elements, are described.

First Embodiment

Figure 1:
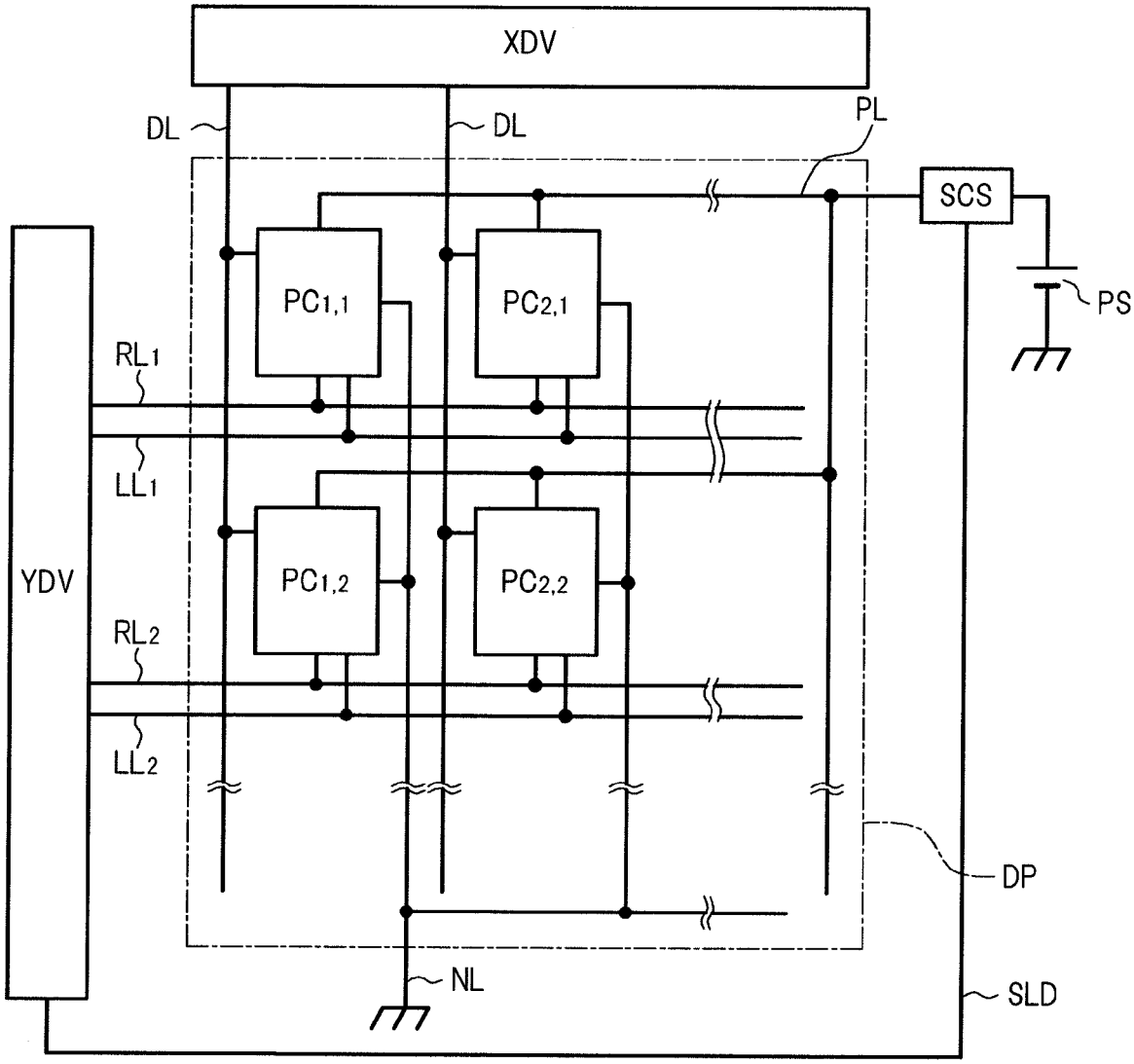
FIG. 1 is a diagram illustrating an equivalent circuit of an image display device according to a first embodiment of the present invention.

FIG. 1 is a diagram illustrating an equivalent circuit of an image display device according to a first embodiment of the present invention. FIG. 1 specifically illustrates a display panel of the image display device according to this embodiment. The display panel includes a plurality of data signal lines DL extending in the vertical direction and arranged side-by-side in the horizontal direction of the figure, a plurality of reset control lines RL extending in the horizontal direction and arranged side-by-side in the vertical direction of the figure, lighting control lines LL provided in correspondence with the reset control lines RL and arranged side-by-side with the corresponding reset control lines RL, respectively, a plurality of pixel circuits PC arranged in matrix to correspond with intersections of the data signal lines DL and the reset control lines RL (lighting control lines LL), a power-supply/GND switching circuit SCS, a data signal line driving circuit XDV, and a scanning line driving circuit YDV. Upper ends of the data signal lines DL are connected to the data signal line driving circuit XDV. Left ends of the reset control lines RL and the lighting control lines LL are connected to the scanning line driving circuit YDV. The plurality of pixel circuits PC form a display area DP. Each of the pixel circuits PC includes a light emitting element IE and a storage capacitor CP. Structure of the pixel circuits PC is described in detail below. The data signal line driving circuit XDV and the scanning line driving circuit YDV are driving circuits that cooperate with each other to drive each of the pixel circuits PC.

A switching signal line group SLD extends from the scanning line driving circuit YDV and is connected to the power-supply/GND switching circuit SCS. The power-supply/GND switching circuit SCS is also connected to a voltage source PS. A first power supply line PL extending from the power-supply/GND switching circuit SCS is connected to each of the pixel circuits PC. Each of the pixel circuits PC is also connected to a second power supply line NL, and the second power supply line NL is connected to a ground electrode. The ground electrode is supplied with a reference potential. In this embodiment, a ground potential is employed as the reference potential. Further, FIG. 1 illustrates only four (2×2) pixel circuits PC, but in practice, as many pixel circuits PC as to correspond to the display resolution are provided. Hereinafter, description is given for 640×480 color display. Hereinafter, the pixel circuit in the n-th row and the m-th column is indicated by $PC_{m,n}$. For example, the pixel circuit on the upper left is indicated by $PC_{1,1}$. Further, the reset control line connected to the pixel circuits in the n-th row is indicated by $RL_n$, and the lighting control line connected to the pixel circuits PC in the n-th row is indicated by $LL_n$.

In the image display device, the plurality of pixel circuits PC are divided into a plurality of pixel circuit groups and driven in the following manner. The driving circuits select the pixel circuit groups sequentially to perform operation of writing potential differences based on data signals in the storage capacitors CP included in the pixel circuits PC belonging to the selected pixel circuit group through the data signal lines. In this case, the data signal lines DL may be shared among the plurality of pixel circuit groups. In this embodiment, the pixel circuits PC in each row are grouped together, and the group is selected using the reset control line RL.

Figure 2:
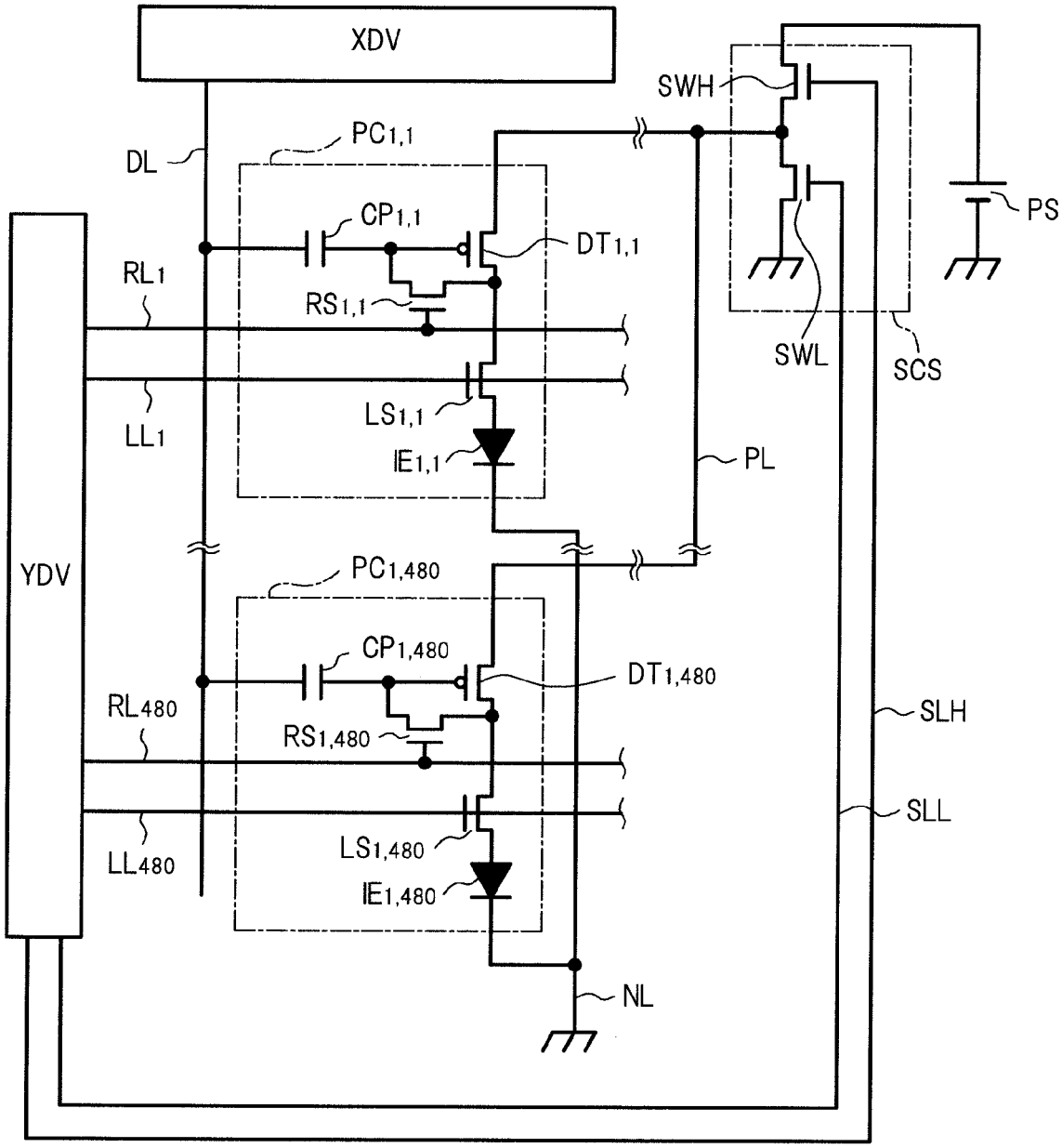
FIG. 2 is a diagram illustrating configurations of pixel circuits and a power-supply/GND switching circuit illustrated in FIG. 1.

FIG. 2 is a diagram illustrating configurations of the pixel circuits PC and the power-supply/GND switching circuit SCS illustrated in FIG. 1. Each of the pixel circuits PC includes the light emitting element IE that changes in luminance depending on an amount of current flowing therethrough, the storage capacitor CP for storing a potential difference across itself, a driving transistor DT for adjusting the amount of current flowing through the light emitting element IE based on the potential difference stored in the storage capacitor CP, a reset switch RS, and a lighting control switch LS.

The light emitting element IE is an organic EL element and emits light of the intensity corresponding to the current flowing therethrough. The organic EL element generally has a rectifying property and is referred to as an OLED. In FIG. 2, the light emitting element IE is illustrated by using a symbol for a diode. The driving transistor DT is a p-channel metal oxide semiconductor (PMOS) thin film transistor. The driving transistor DT includes a gate electrode connected to one end of the storage capacitor CP and a source electrode connected to the first power supply line PL. The other end of the storage capacitor CP is connected to the data signal line driving circuit XDV through the data signal line DL corresponding to the pixel circuit PC. The reset switch RS is formed of an n-channel metal oxide semiconductor (NMOS) thin film transistor and includes a gate electrode connected to the reset control line RL corresponding to the row of the pixel circuit PC, and a source electrode and a drain electrode, one of which being connected to the gate electrode of the driving transistor DT and the other being connected to a drain electrode of the driving transistor DT. The lighting control switch LS is formed of an NMOS thin film transistor, is provided between the drain electrode of the driving transistor DT and an anode electrode of the light emitting element IE, and includes a gate electrode connected to the lighting control line LL corresponding to the row of the pixel circuit PC. The light emitting element IE includes a cathode electrode connected to the second power supply line NL. It should be noted that, in the following, the light emitting element IE, the storage capacitor CP, the driving transistor DT, the reset switch RS, and the lighting control switch LS included in the pixel circuit PC in the n-th row and the m-th column are indicated by suffixing m,n to the respective reference symbols thereof.

The power-supply/GND switching circuit SCS includes a common power supply switch SWH and a common GND switch SWL, each of which is an NMOS thin film transistor. Each of the common power supply switch SWH and the common GND switch SWL includes a drain electrode connected to the first power supply line PL. The common power supply switch SWH includes a source electrode connected to the voltage source PS, and the common GND switch SWL includes a source electrode connected to the ground electrode. The common power supply switch SWH includes a gate electrode connected to the scanning line driving circuit YDV through a common power supply control line SLH, and the common GND switch SWL includes a gate electrode connected to the scanning line driving circuit YDV through a common GND control line SLL. The common power supply control line SLH and the common GND control line SLL constitute the switching signal line group SLD of FIG. 1. It should be noted that one of the common power supply switch SWH and the common GND switch SWL may be formed of a PMOS transistor so that the common power supply control line SLH and the common GND control line SLL may be integrated. In this embodiment, the power-supply/GND switching circuit SCS serves as a switch unit for selectively supplying one of a power supply potential and the reference potential as a potential to be supplied to the first power supply line PL. The voltage source PS supplies the power supply potential through a power supply potential line connected thereto. The ground electrode supplies the reference potential through a reference potential line connected thereto.

Figure 3A:
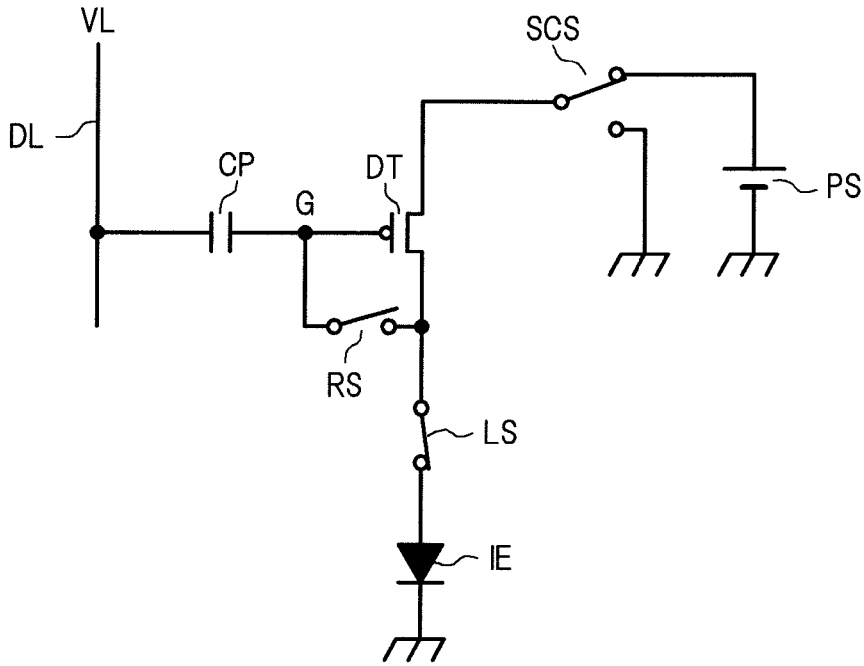
FIG. 3A is a diagram illustrating a state of the pixel circuit in a light emission period.
Figure 3B:
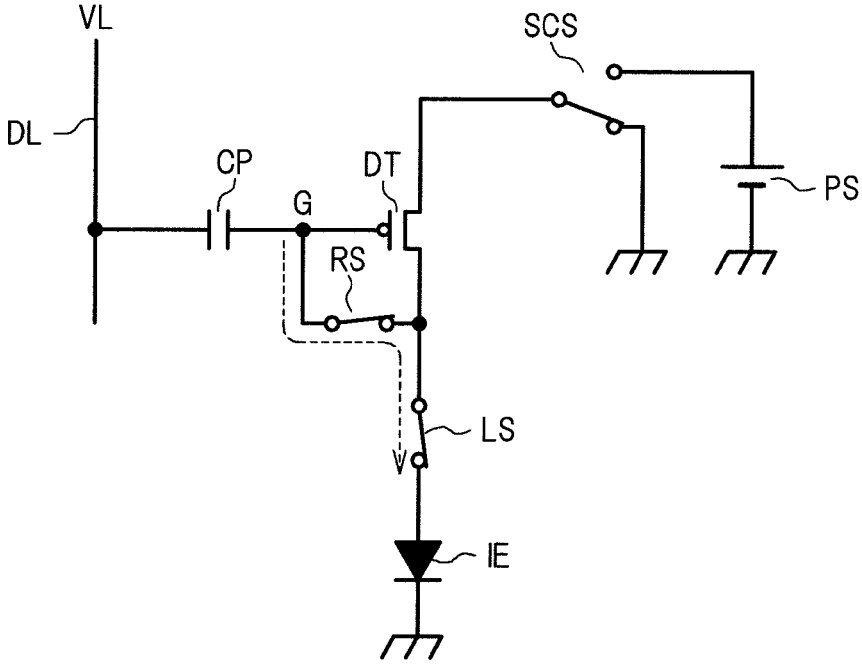
FIG. 3B is a diagram illustrating a state of the pixel circuit in a storage capacitor discharge period.
Figure 3C:
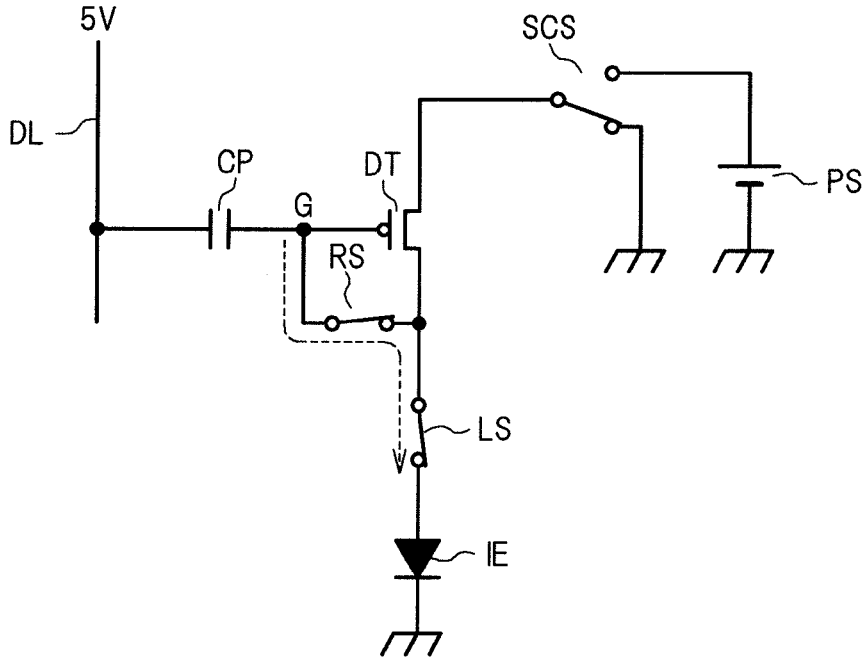
FIG. 3C is a diagram illustrating a state of the pixel circuit in a storage capacitor discharge period.
Figure 3D:
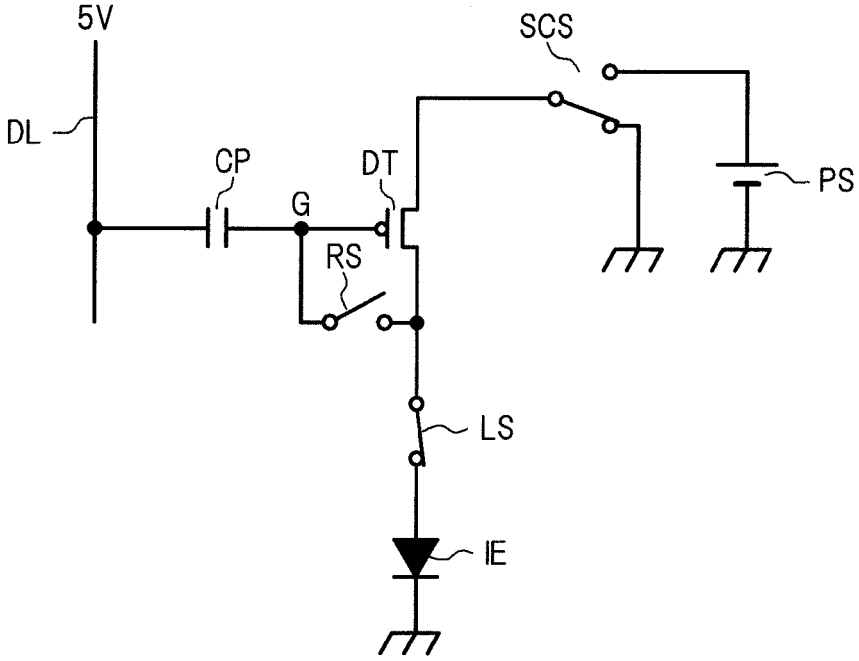
FIG. 3D is a diagram illustrating a state of the pixel circuit in a storage capacitor discharge period.
Figure 3E:
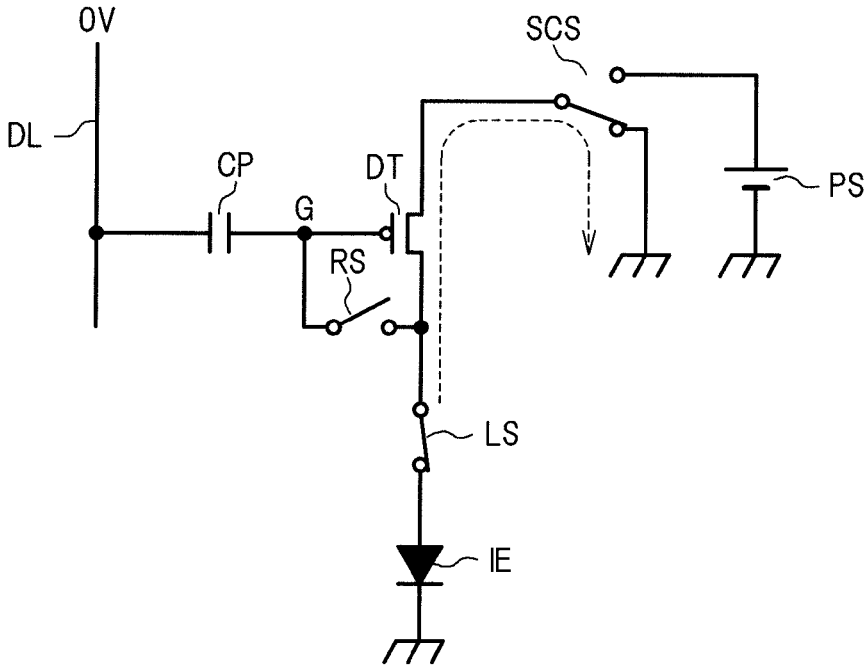
FIG. 3E is a diagram illustrating a state of the pixel circuit in a Di discharge period.
Figure 3F:
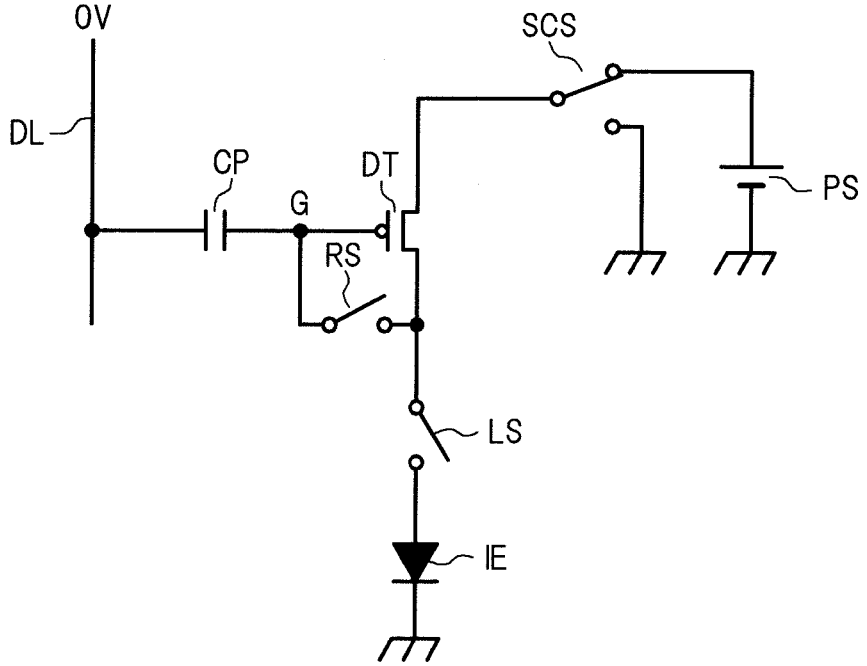
FIG. 3F is a diagram illustrating a state of the pixel circuit in a write period.
Figure 3G:
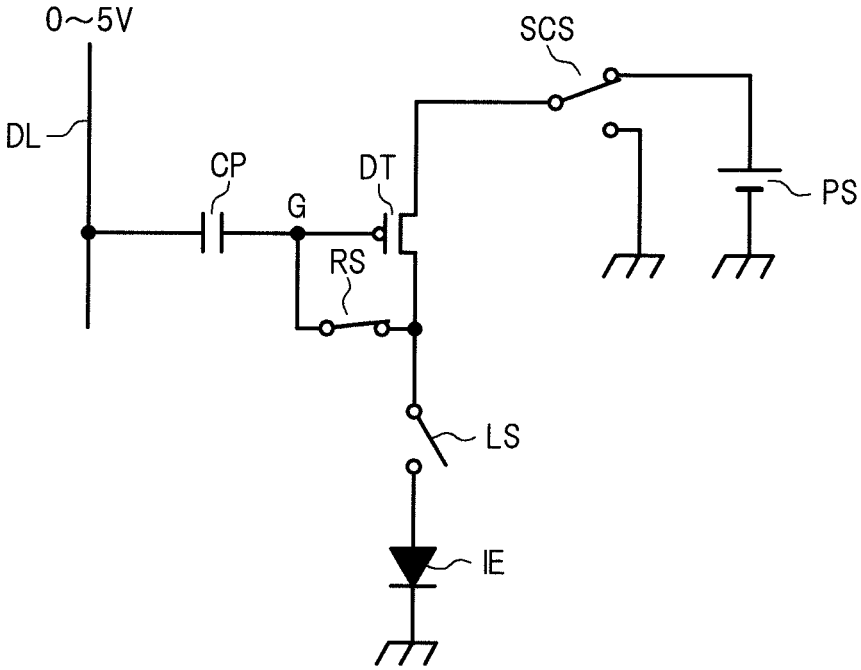
FIG. 3G is a diagram illustrating a state of the pixel circuit in a write period.
Figure 4:
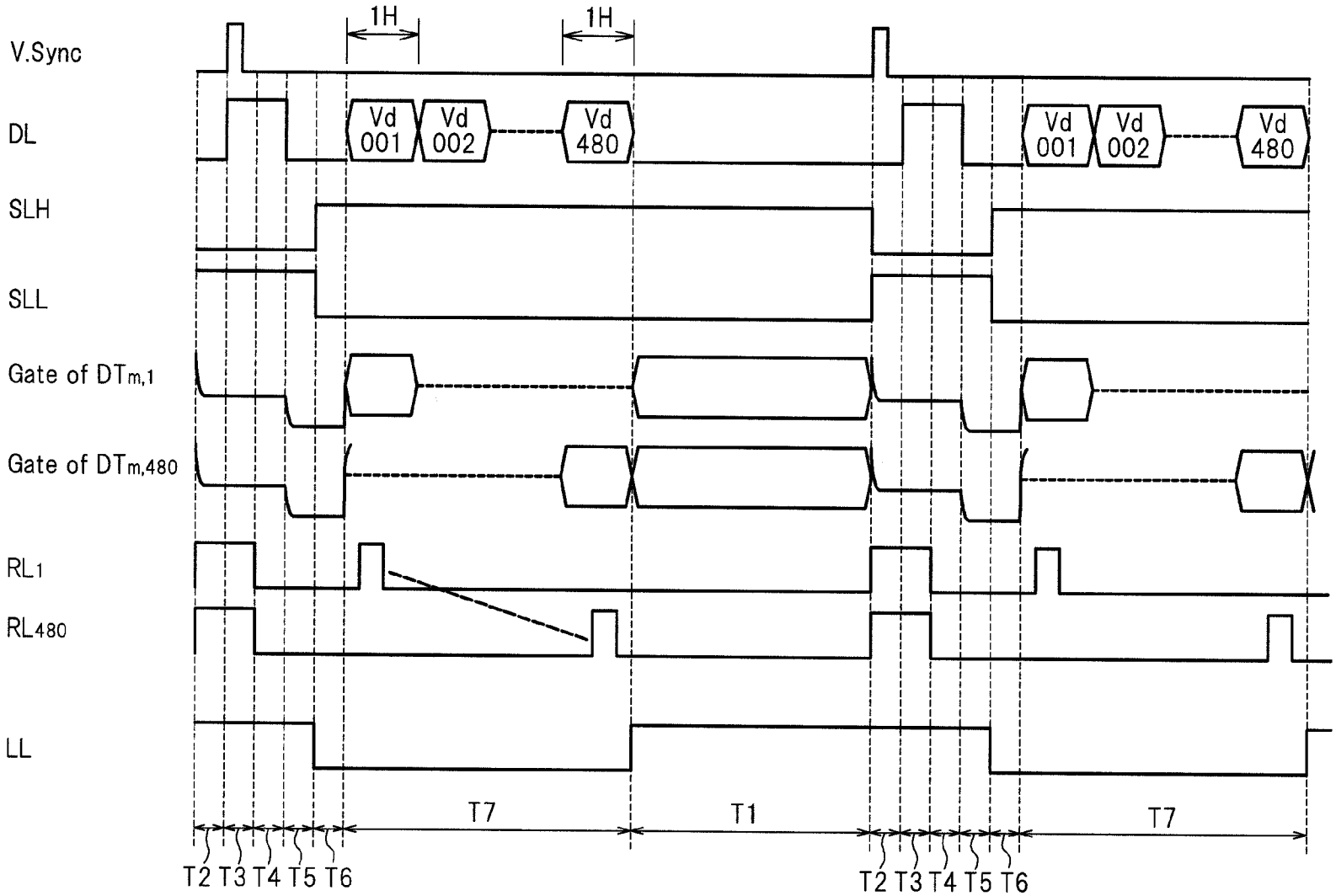
FIG. 4 is a waveform chart illustrating signals supplied from various wirings.

Referring to FIGS. 3A to 3G and 4, operation of the pixel circuits PC according to this embodiment is described. FIG. 4 is a waveform chart illustrating signals supplied from various wirings. The waveform chart illustrates a vertical synchronization signal (V.Sync) supplied to the scanning line driving circuit YDV, a signal supplied to the data signal lines DL, a signal supplied to the common power supply control line SLH, a signal supplied to the common GND control line SLL, a potential supplied to the gate electrode of the driving transistor $DT_{m,1}$ in the first row and the m-th column, a potential supplied to the gate electrode of the driving transistor $DT_{m,480}$ in the 480-th row and the m-th column, a signal supplied to the reset control line $RL_1$ of the first row, a signal supplied to the reset control line $RL_{480}$ of the 480-th row, and a signal supplied to the lighting control line LL of each row in this order from above. A frame period, which is a period in which image data for an image constituting a moving image is written and the image is displayed, includes a light emission period T1, storage capacitor discharge periods T2, T3, and T4 for discharging the storage capacitor CP, a Di discharge period T5 for discharging the light emitting element IE, and write periods T6 and T7 in this order. The data signal line driving circuit XDV supplies the signal to the data signal lines DL, and the scanning line driving circuit YDV supplies the signals to the reset control lines RL, the lighting control lines LL, the common power supply control line SLH, and the common GND control line SLL.

FIG. 3A is a diagram illustrating a state of the pixel circuit PC in the light emission period T1. In the light emission period T1, the light emitting element IE included in each pixel circuit PC performs operation of emitting light of the intensity corresponding to a gate potential of the driving transistor DT. The gate potential of the driving transistor DT is a potential obtained by adding a voltage that is written in the storage capacitor CP in the preceding write period T7 to a potential VL that is applied to the data signal lines DL in the light emission period T1. At this time, with the potential of the common power supply control line SLH being high (hereinafter, abbreviated as H) and the potential of the common GND control line SLL being low (hereinafter, abbreviated as L), the first power supply line PL is supplied with the power supply potential from the voltage source PS. Further, with the potential of the reset control line RL being L, the reset switch RS is turned off. With the potential of the lighting control line LL being H, the lighting control switch LS is turned on. The potential VL of the data signal lines determines a light emitting current for the entire screen. In this case, the light emission period T1 is the same period for every row of the pixel circuits PC, and the light emission period T1 is not different for each row.

FIG. 3B is a diagram illustrating a state of the pixel circuit PC in the storage capacitor discharge period T2. In the storage capacitor discharge period T2, the potential of the data signal lines DL is set to VL as in the light emission period T1. With the potential of the common power supply control line SLH being L and the potential of the common GND control line SLL being H, the first power supply line PL is supplied with the reference potential. Further, with the potential of the reset control line RL and the potential of the lighting control line LL being H, the reset switch RS and the lighting control switch LS are turned on. As a result, the potential of the source electrode of the driving transistor DT is set to a GND potential (0 V), and the potentials of the drain electrode and the gate electrode of the driving transistor DT are set to a minimum voltage Vdmin (about 1.5 V in this embodiment) of the light emitting element IE. At this time, electric charges in the storage capacitor CP are allowed to flow through the light emitting element IE to the ground electrode. However, the electric charges to be removed from the storage capacitor CP are limited in amount. Therefore, a current flowing through the light emitting element IE is very small compared to that in the light emission period, and the light emitting element IE emits very little light. In this embodiment, the potential of the gate electrode of the driving transistor DT reflects Vdmin and is about 1.5 V. With the potential supplied from the first power supply line being the reference potential, no current flows from the first power supply line to the light emitting element IE.

FIG. 3C is a diagram illustrating a state of the pixel circuit PC in the storage capacitor discharge period T3. FIG. 3D is a diagram illustrating a state of the pixel circuit PC in the storage capacitor discharge period T4. In the storage capacitor discharge period T3, the potential applied to the data signal lines DL is changed from VL to a high-level potential Vw (5 V corresponding to white display in this embodiment). Also at this time, the electric charges in the storage capacitor CP are allowed to flow through the light emitting element IE to the ground electrode. However, for the same reason as in the storage capacitor discharge period T2, the current flowing through the light emitting element IE is very small, and the light emitting element IE emits very little light. Meanwhile, the potential difference of 3.5 V, which is a difference between the high-level potential and the potential of the gate electrode of the driving transistor DT, is generated across the storage capacitor CP. Then, in the last storage capacitor discharge period T4, the potential of the reset control line RL is set to L, and the reset switch RS is turned off.

FIG. 3E is a diagram illustrating a state of the pixel circuit PC in the Di discharge period T5. In the Di discharge period T5, the potential applied to the data signal lines DL is changed to a low level potential Vb (0 V corresponding to black display in this embodiment). As a result, the gate potential Vg of the driving transistor DT is set to a negative potential (Vg=Vdmin−(Vw−Vb), that is −3.5 V in this embodiment), and a channel is formed between the drain electrode and the source electrode of the driving transistor DT. Then, a current is allowed to flow from the drain electrode to the source electrode, and electric charges stored in the light emitting element IE are transferred through the first power supply line PL to the ground electrode, to thereby reset an amount of the charges stored in the light emitting element IE to a reference state. This operation also includes pre-charge operation, to thereby ensure stability in write operation. In this case, the current is allowed to flow from the drain electrode to the source electrode because the thin film transistor has no polarity. It should be noted that, in this example, the source electrode and the drain electrode are denoted as such based on whether the potential is high or low in the light emission period.

FIG. 3F is a diagram illustrating a state of the pixel circuit PC in the write period T6. In the write period T6, which is a stage before the data signal is written in the storage capacitor CP included in each of the pixel circuits PC, the potentials of all the lighting control lines LL are set to L, and the lighting control switches LS are turned off. Further, in preparation for the subsequent operation, the potential of the common power supply control line SLH is set to H, and the potential of the common GND control line SLL is set to L. As a result, the first power supply line PL is supplied with the power supply potential.

FIG. 3G is a diagram illustrating a state of the pixel circuit PC in the write period T7. In this operation, the data signals are written for each row of the pixel circuits PC. In this embodiment, the write operation is performed for 480 rows. The pixel circuits PC in the row to be subjected to the write operation are selected by setting the potential of the reset control line RL of the row to be subjected to the write operation to H, and the data signals to be written to the storage capacitors CP are supplied to the data signal lines DL. After the writing, operation of setting the potential of the reset control line RL of the corresponding row to L is performed repeatedly. A time period required to write in one row is referred to as 1 H. The write period T7 is followed by the light emission period T1 for the next frame, and subsequently the operation is repeated.

With the configuration of this embodiment, the switch is provided outside the pixel circuits PC, in other words, outside the display area DP, and hence a discharge function may be realized without increasing the number of transistors in the pixel circuits PC. Further, the write period and the light emission period are separated in one frame. Therefore, when the potential differences based on video signals are to be written in the storage capacitors CP of the pixel circuits PC in any one row, the current from the first power supply line does not flow through the light emitting elements included in the pixel circuits PC in every row. As a result, a switch may be shared among a plurality of rows.

In the above description of the first embodiment, the power-supply/GND switching circuit selectively supplies the power supply potential and the reference potential, but the potential to be selectively supplied with the power supply potential is not limited the reference potential. The potential may be set arbitrarily as long as the electric charges in the light emitting element IE are reset to a predetermined state and the current does not flow through the light emitting element IE because of the potential difference generated between the first power supply line and the second power supply line.

Second Embodiment

Figure 5:
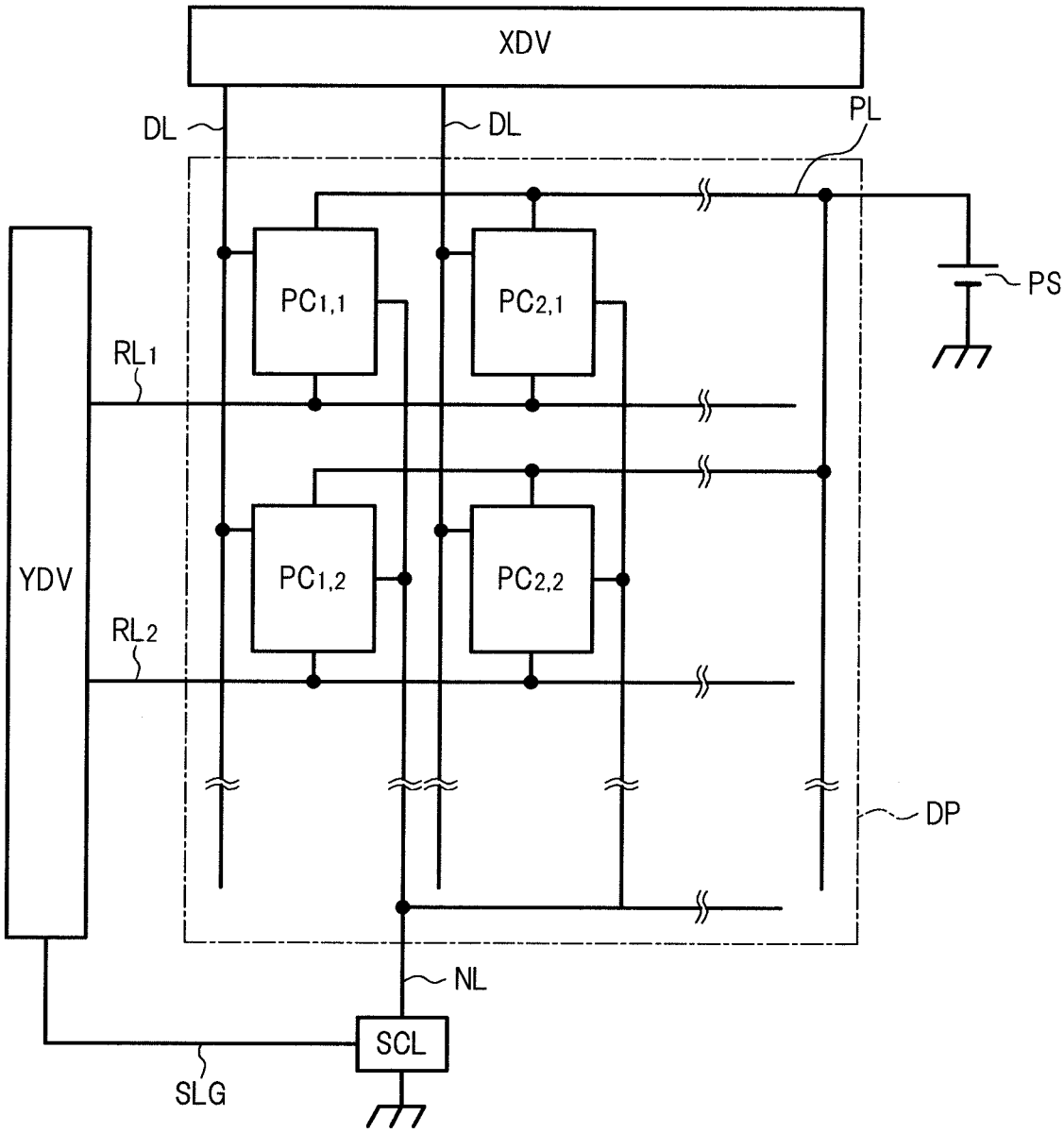
FIG. 5 is a diagram illustrating an equivalent circuit of an image display device according to a second embodiment of the present invention.

In the following, a second embodiment of the present invention is described mainly in terms of differences from the first embodiment. FIG. 5 is a diagram illustrating an equivalent circuit of an image display device according to the second embodiment of the present invention. Similarly to the first embodiment, FIG. 5 specifically illustrates a display panel. The display panel includes a plurality of data signal lines DL extending in the vertical direction and arranged side-by-side in the horizontal direction of the figure, a plurality of reset control lines RL extending in the horizontal direction and arranged side-by-side in the vertical direction of the figure, pixel circuits PC arranged in matrix to correspond with intersections of the data signal lines DL and the reset control lines RL, a lighting control circuit SCL, a data signal line driving circuit XDV, and a scanning line driving circuit YDV. Upper ends of the data signal lines DL are connected to the data signal line driving circuit XDV. Left ends of the reset control lines RL are connected to the scanning line driving circuit YDV. Each of the pixel circuits PC includes a light emitting element IE. The plurality of pixel circuits PC form a display area DP.

A common lighting control line SLG extends from the scanning line driving circuit YDV and is connected to the lighting control circuit SCL. The lighting control circuit SCL is also connected to a ground electrode. A second power supply line NL extending from the lighting control circuit SCL is connected to each of the pixel circuits PC. Each of the pixel circuits PC is also connected to a first power supply line PL, and the first power supply line PL is connected to a voltage source PS.

Figure 6:
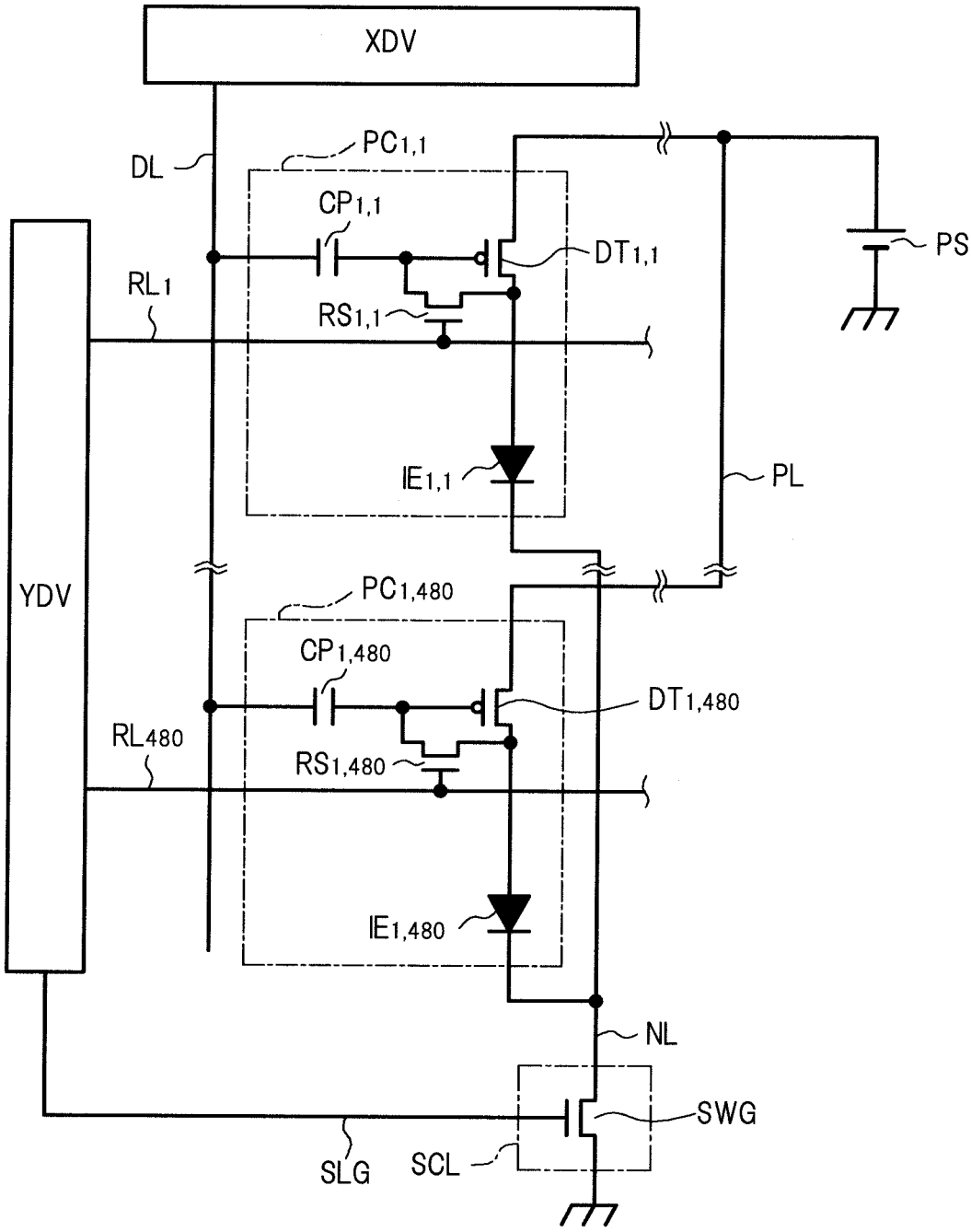
FIG. 6 is a diagram illustrating configurations of pixel circuits and a lighting control circuit illustrated in FIG. 5.

FIG. 6 is a diagram illustrating configurations of the pixel circuits PC and the lighting control circuit SCL illustrated in FIG. 5. Each of the pixel circuits PC includes the light emitting element IE, a storage capacitor CP for storing a potential difference across itself, a driving transistor DT for adjusting the amount of current flowing through the light emitting element IE based on the potential difference stored in the storage capacitor CP, and a reset switch RS.

The driving transistor DT includes a gate electrode connected to one end of the storage capacitor CP and a source electrode connected to the first power supply line PL. The other end of the storage capacitor CP is connected to the data signal line DL corresponding to the pixel circuit PC. The reset switch RS includes a gate electrode connected to the reset control line RL corresponding to the row to which the pixel circuit PC belongs, and a source electrode and a drain electrode, one of which being connected to the gate electrode of the driving transistor DT and the other being connected to a drain electrode of the driving transistor DT. The light emitting element IE includes an anode electrode connected to the drain electrode of the driving transistor DT and a cathode electrode connected to the second power supply line NL.

The lighting control circuit SCL includes a common lighting control switch SWG formed of an NMOS thin film transistor. The common lighting control switch SWG includes a gate electrode connected to the common lighting control line SLG, a source electrode connected to the second power supply line NL, and a drain electrode connected to the ground electrode. In this embodiment, the lighting control circuit SCL serves as a switch unit for controlling whether or not to supply the reference potential to the second power supply line.

Figure 7A:
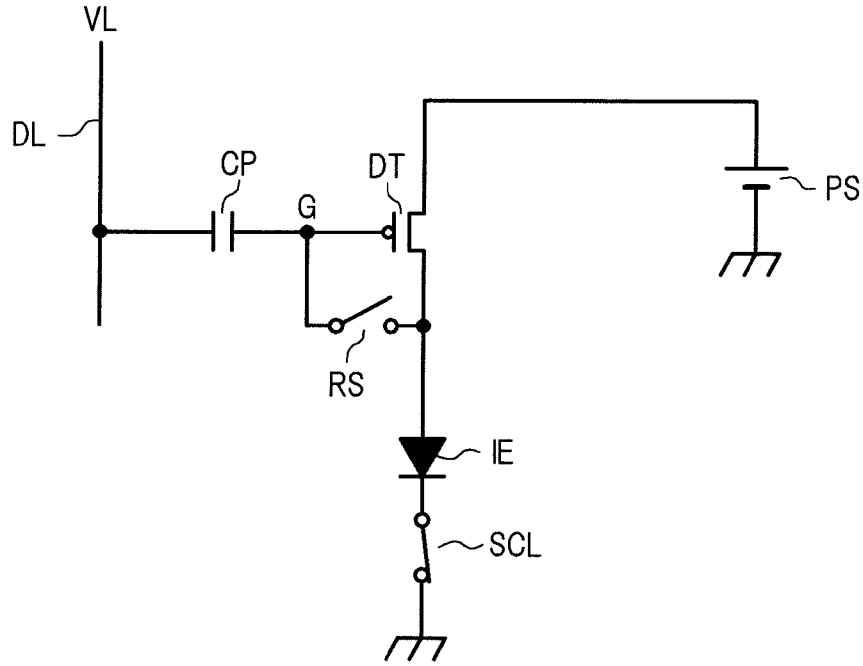
FIG. 7A is a diagram illustrating a state of the pixel circuit in a light emission period.
Figure 7B:
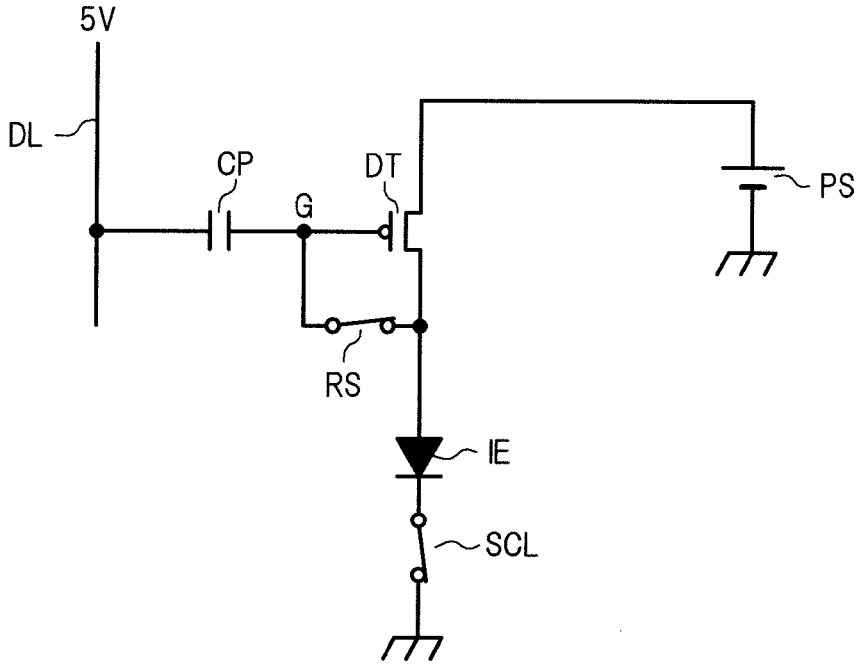
FIG. 7B is a diagram illustrating a state of the pixel circuit in a pre-charge period.
Figure 7C:
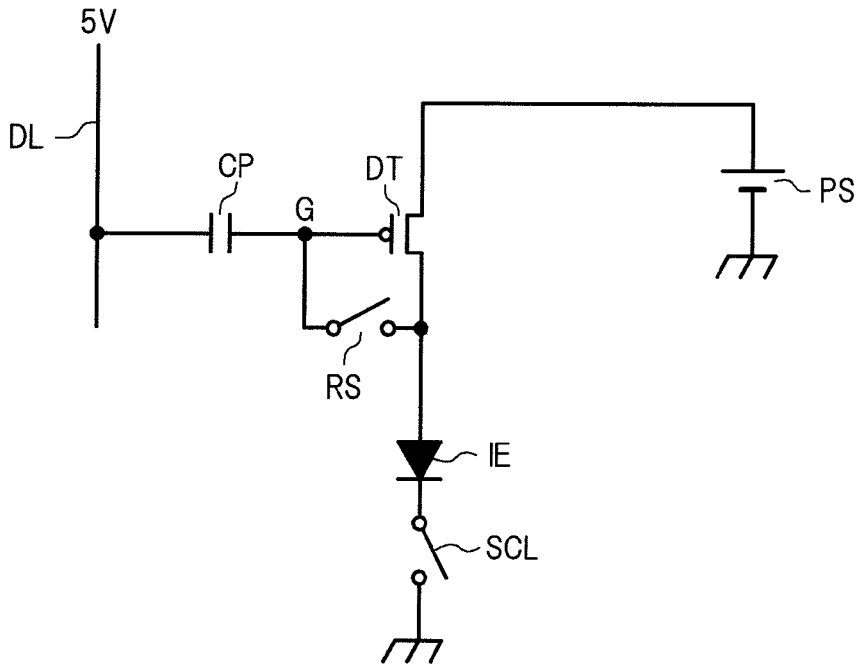
FIG. 7C is a diagram illustrating a state of the pixel circuit in a write period.
Figure 7D:
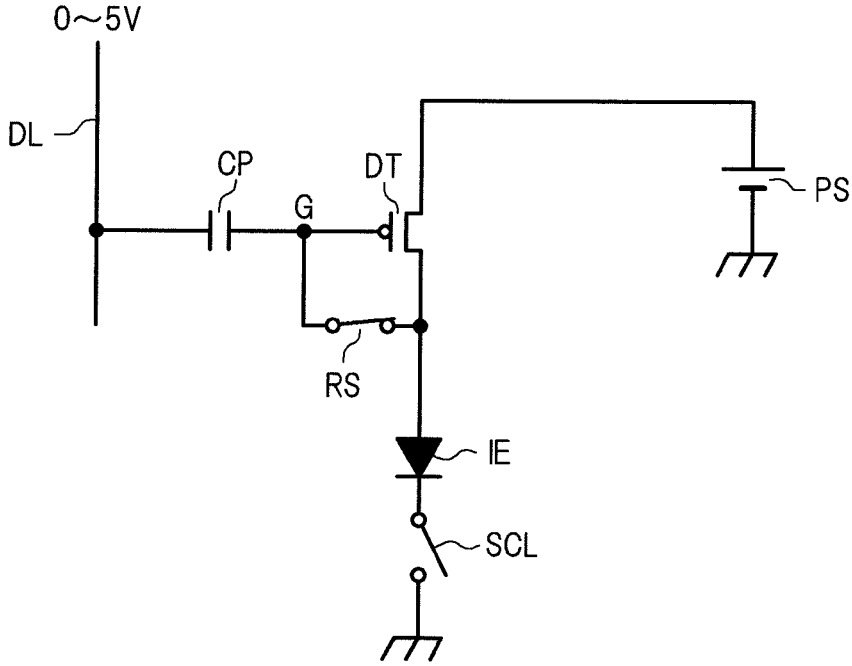
FIG. 7D is a diagram illustrating a state of the pixel circuit in a write period.
Figure 8:
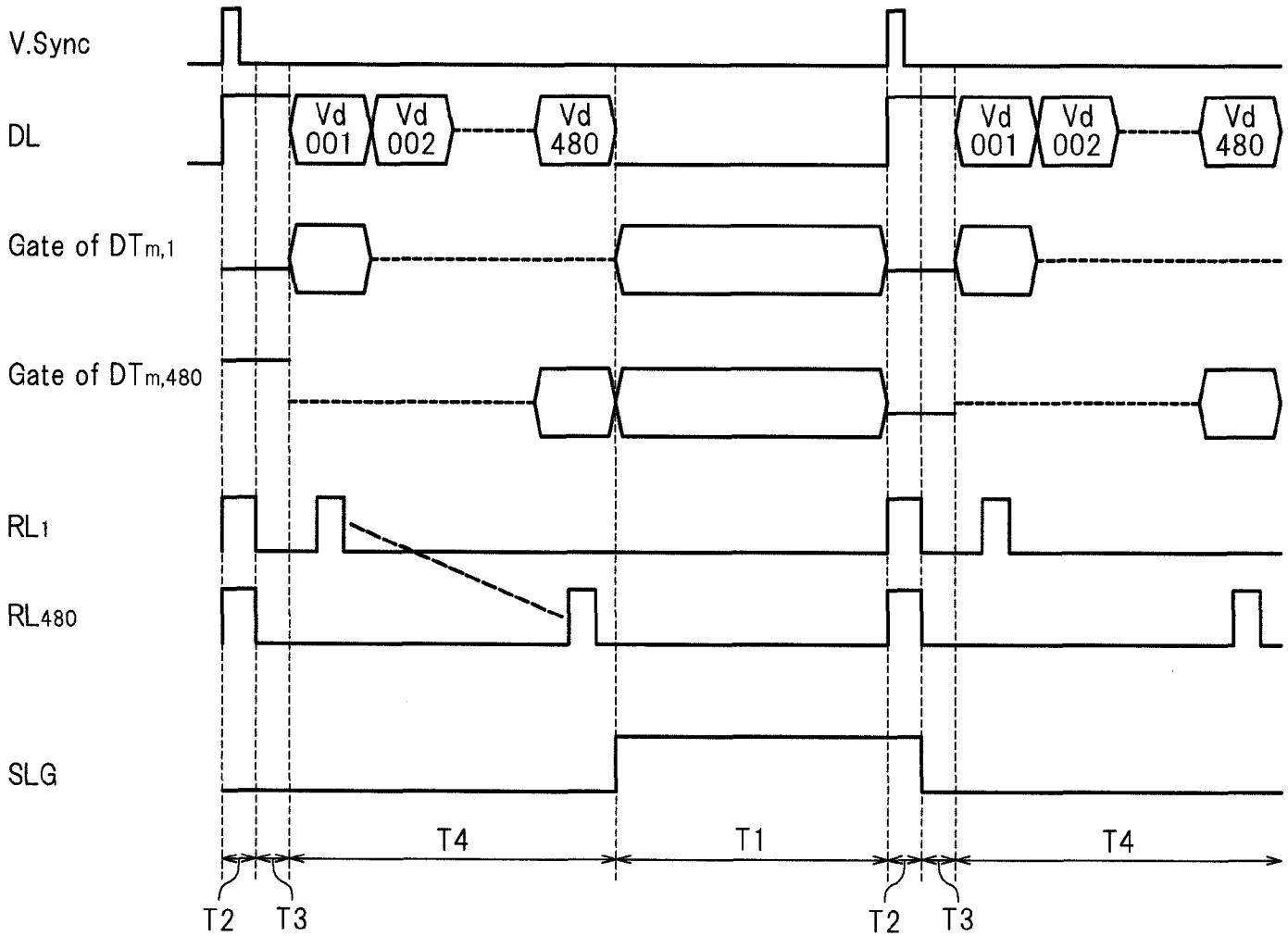
FIG. 8 is a waveform chart illustrating signals supplied from various wirings.

Referring to FIGS. 7A to 7D and 8, operation of the pixel circuits PC according to this embodiment is described. FIG. 8 is a waveform chart illustrating signals supplied from various wirings. The waveform chart illustrates a vertical synchronization signal (V.Sync) supplied to the scanning line driving circuit YDV, a signal supplied to the data signal lines DL, a signal supplied to the gate electrode of the driving transistor $DT_{m,1}$ in the first row and the m-th column, a signal supplied to the gate electrode of the driving transistor $DT_{m,480}$ in the 480-th row and the m-th column, a signal supplied to the reset control line $RL_1$ of the first row, a signal supplied to the reset control line $RL_{480}$ of the 480-th row, and a signal supplied to the common lighting control line SLG in this order from above. A frame period includes a light emission period T1, a pre-charge period T2 for pre-charging the storage capacitor CP, and write periods T3 and T4 in this order. The data signal line driving circuit XDV supplies the signal to the data signal lines DL, and the scanning line driving circuit YDV supplies the signals to the reset control lines RL and the common lighting control line SLG.

FIG. 7A is a diagram illustrating a state of the pixel circuit PC in the light emission period T1. In the light emission period T1, the light emitting element IE included in each pixel circuit PC performs operation of emitting light of the intensity corresponding to the gate potential of the driving transistor DT, which is determined by the potential difference that is written in the storage capacitor CP in the preceding write period T4 and a potential VL that is applied to the data signal lines DL in the light emission period T1. At this time, with the potential of the reset control line RL being L, the reset switch RS is turned off. Further, with the potential of the common lighting control line SLG being H, the second power supply line NL and the ground electrode are connected to each other so that the current is allowed to flow from the voltage source PS through the light emitting element IE to the ground electrode. The potential VL of the data signal lines determines alight emitting current for the entire screen. Further, as in the first embodiment, the light emission period T1 is the same period for every row of the pixel circuits PC, and the light emission period T1 is not different for each row.

FIG. 7B is a diagram illustrating a state of the pixel circuit PC in the pre-charge period T2. In the pre-charge period T2, the potential applied to the data signal lines DL is changed from VL to a high-level potential Vw (5 V corresponding to white display in this embodiment), and the potential of the reset control line RL is set to H. With the second power supply line NL and the ground electrode being connected to each other, the current is allowed to flow from the storage capacitor CP to the ground electrode to discharge the storage capacitor CP and decrease the potential of the gate electrode of the driving transistor DT. Meanwhile, the current is also allowed to flow from the voltage source PS through the light emitting element IE to the ground electrode. Therefore, a period of time in which the reset switch RS is turned on may be set to a period of time required for the gate potential to decrease to such an extent (about 4 V in this embodiment) as to enable auto zero operation in the coming write period T4. The time period is so short that the light emission in the light emitting element IE is very little and of a negligible level when compared to the light emission in the light emission period T1.

FIG. 7C is a diagram illustrating a state of the pixel circuit PC in the write period T3. In the write period T3, which is a stage before a data signal is written in the storage capacitor CP included in each of the pixel circuits PC, the potential of the common lighting control line SLG is set to L, and the common lighting control switch SWG between the second power supply line NL and the ground electrode is turned off. As a result, the current from the first power supply line to the second power supply line is blocked in the subsequent write period T4 so as to prevent the light emitting element from being lit.

FIG. 7D is a diagram illustrating a state of the pixel circuit PC in the write period T4. In this operation, the data signals are written for each row of the pixel circuits PC. In this embodiment, the write operation is performed for 480 rows. The pixel circuits PC in the row to be subjected to the write operation are selected by setting the potential of the reset control line RL of the row to be subjected to the write operation to H, the data signals to be written to the storage capacitors CP are supplied to the data signal lines DL, and the potential is set to L after the writing. The series of operation steps is performed repeatedly for each row. During this time, the common lighting control switch SWG is off. The write period T4 is followed by the light emission period T1 for the next frame, and subsequently the operation is repeated.

With the configuration of this embodiment, the common lighting control switch SWG provided outside the pixel circuits PC enables the lighting control of the light emitting element IE and the pre-charge operation of the storage capacitor CP.

Third Embodiment

Figure 9:
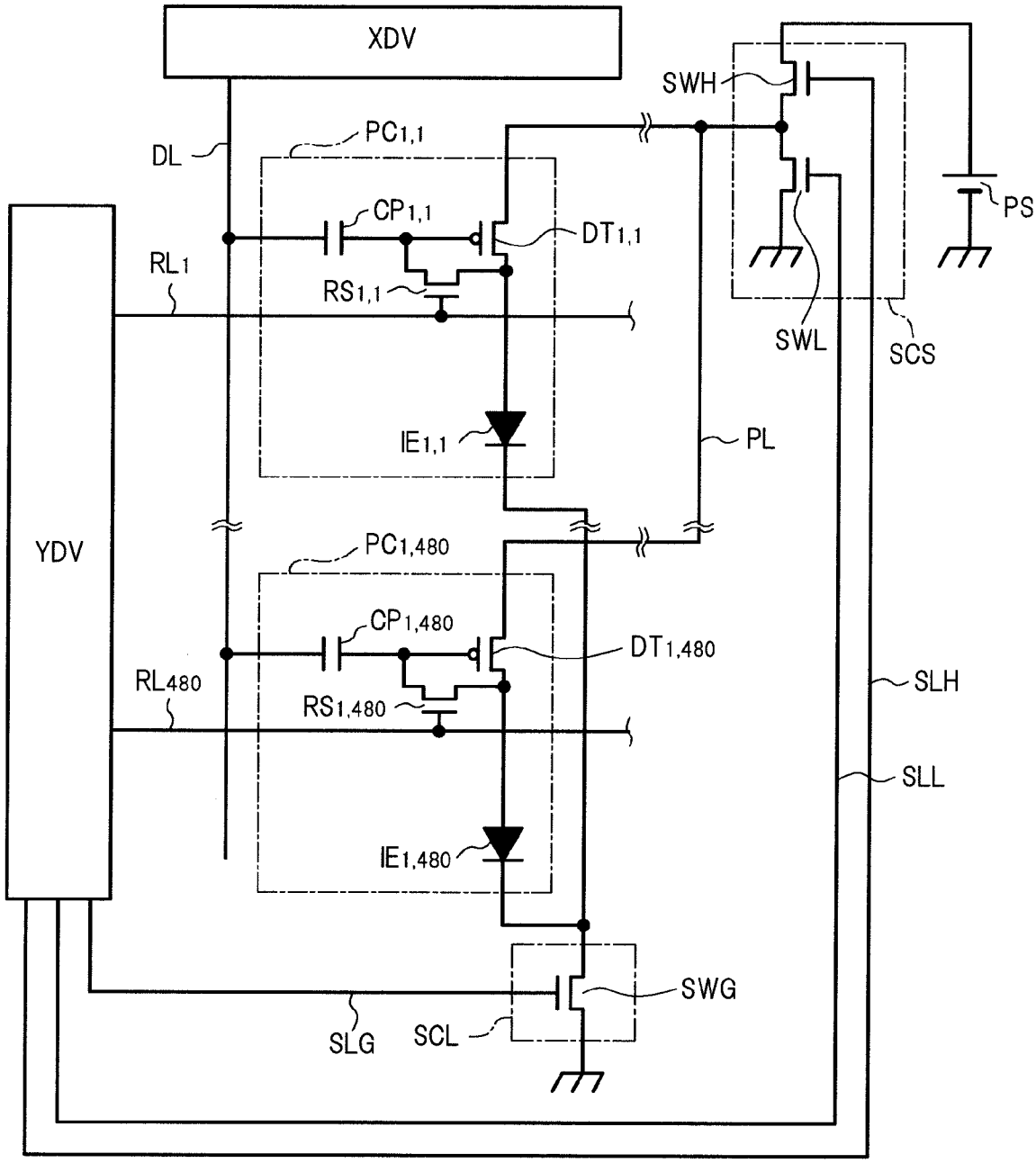
FIG. 9 is a diagram illustrating configurations of pixel circuits, a power-supply/GND switching circuit, and a lighting control circuit according to a third embodiment of the present invention.

A third embodiment of the present invention has a configuration in which the lighting control switches LS of the first embodiment may be integrated for the plurality of pixel circuits PC as in the second embodiment. In the following, differences from the first embodiment are mainly described. FIG. 9 is a diagram illustrating configurations of pixel circuits PC, a power-supply/GND switching circuit SCS, and a lighting control circuit SCL according to a third embodiment of the present invention. The third embodiment is mainly different from the first embodiment in that there is no lighting control line LL, and in that a lighting control circuit SCL is provided between the second power supply line NL and the ground electrode while the lighting control switch LS is not included in each of the pixel circuits PC.

The image display device includes a plurality of data signal lines DL extending in the vertical direction of the figure, a plurality of reset control lines RL extending in the horizontal direction of the figure, pixel circuits PC arranged in matrix to correspond with intersections of the data signal lines DL and the reset control lines RL, a power-supply/GND switching circuit SCS, a lighting control circuit SCL, a data signal line driving circuit XDV, and a scanning line driving circuit YDV. The data signal lines DL are connected to the data signal line driving circuit XDV, and the reset control lines RL, a common power supply control line SLH, a common GND control line SLL, and a common lighting control line SLG are connected to the scanning line driving circuit YDV. The configuration of the power-supply/GND switching circuit SCS is the same as in the first embodiment, and the configuration of the lighting control circuit SCL is the same as in the second embodiment.

Each of the pixel circuits PC includes a light emitting element IE, a storage capacitor CP for storing a potential difference across itself, a driving transistor DT for adjusting a current flowing through the light emitting element IE based on the potential difference stored in the storage capacitor CP, and a reset switch RS. The driving transistor DT includes a gate electrode connected to one end of the storage capacitor CP and a source electrode connected to the first power supply line PL. The other end of the storage capacitor CP is connected to the data signal line DL corresponding to the pixel circuit PC. The reset switch RS includes a gate electrode connected to the reset control line RL corresponding to the row to which the pixel circuit PC belongs, and a source electrode and a drain electrode, one of which being connected to the gate electrode of the driving transistor DT and the other being connected to a drain electrode of the driving transistor DT. The light emitting element IE includes an anode electrode connected to the drain electrode of the driving transistor DT and a cathode electrode connected to the second power supply line NL.

Operation of the pixel circuits PC of this embodiment is similar to that in the first embodiment except that the signals to the lighting control lines LL are replaced by signals to the common lighting control line SLG, and hence the description thereof is omitted. With this configuration, the circuit configuration may be further simplified compared with the first embodiment.

Fourth Embodiment

Figure 10:
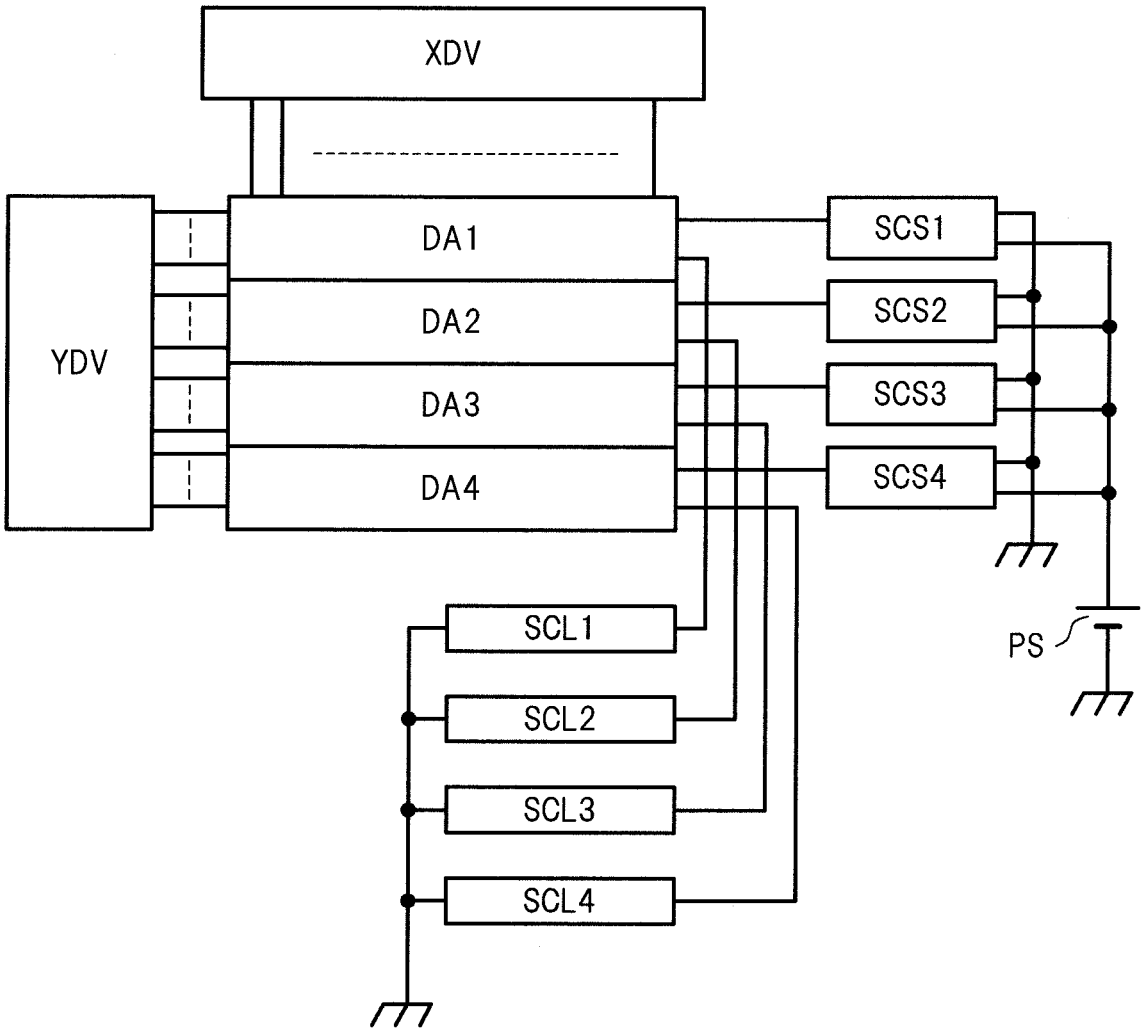
FIG. 10 is a diagram illustrating a schematic configuration of an image display device according to a fourth embodiment of the present invention.

A fourth embodiment of the present invention is an example in which the configurations of the embodiments described above are applied to an image display device employing a split-screen light emission method. In the following, an example in which the configuration of the third embodiment is applied is specifically described. FIG. 10 is a diagram illustrating a schematic configuration of an image display device according to the fourth embodiment of the present invention. In this example, the screen of the image display device is divided in four in the vertical direction. A display area DP includes a first display area DA1, a second display area DA2, a third display area DA3, and a fourth display area DA4 in this order from above. Each of the first display area to the fourth display area corresponds to the display area DP of the third embodiment, and power-supply/GND switching circuits SCS1 to SCS4 and lighting control circuits SCL1 to SCL4 are provided for the first display area to the fourth display area, respectively. Also in the image display device employing the above-mentioned split-screen method, the configuration of each pixel circuit may be simplified.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An image display device, comprising:

a plurality of pixel circuit groups each including at least one pixel circuit;

a first power supply line connected to each pixel circuit of the plurality of pixel circuit groups;

a second power supply line connected to each pixel circuit of the plurality of pixel circuit groups;

a driving circuit for supplying a data signal and a scanning signal to each pixel circuit; and a switch unit provided at an end of the first power supply line and outside an area occupied by the pixel circuits:

wherein the switch unit selectively supplies one of a power supply potential and a predetermined potential to the first power supply line; and wherein the switch unit is shared among a plurality of rows;

wherein each pixel circuit comprises:

a light emitting element for emitting light in response to a current flowing therethrough;

a driving transistor provided between the first power supply line and the second power supply line to control the current flowing through the light emitting element;

a reset switch provided between a gate electrode and a drain electrode of the driving transistor;

a storage capacitor provided between a data signal line and a gate electrode of the driving transistor; and a lighting control switch provided between one end of the light emitting element and the drain electrode of the driving transistor, wherein:

each pixel circuit operates to provide a light emission period, a discharge period and a write period;

the driving transistor is comprised of a p-channel type transistor;

in the write period, the driving circuit selects the pixel circuit groups one by one to cause the storage capacitor in each pixel circuit included in the selected one of the pixel circuit groups to store a potential difference between the data signal line and the gate electrode of the driving transistor;

in the light emission period which is common to the pixel circuit groups, the driving circuit causes the light emitting element in each pixel circuit to emit light of an intensity corresponding to the potential difference;

in the discharge period which is different from the write period and the light emission period, the reset switch is connected to discharge the storage capacitor through the light emitting element;

a source electrode of the driving transistor is connected to the first power supply line; and another end of the light emitting element is connected to the second power supply line, the second power supply line is supplied with a reference potential; and in the discharge period, the switch unit changes potential of the source electrode of the driving transistor to the predetermined potential to set electric charges stored in the light emitting element to a predetermined reference state.

2. The image display device according to claim 1, wherein the predetermined potential is the reference potential.

3. The image display device according to claim 1, wherein said p-channel type transistor is comprised of a PMOS transistor.

4. The image display device according to claim 3, wherein said PMOS transistor includes a gate electrode coupled to one end of the storage capacitor and wherein the source electrode of the PMOS transistor is coupled to the first power supply line, and the drain electrode is coupled to the light emitting element.

5. The image display device according to claim 4, wherein the lighting control switch is provided between the drain electrode of said PMOS transistor and the light-emitting element.

6. The image display device according to claim 5, wherein said lighting control switch comprises an NMOS transistor.

7. The image display device according to claim 6, wherein said driving transistor is configured to be in a conductive state at the end of said discharge period.

8. The image display device according to claim 4, wherein said driving transistor is configured to be in a conductive state at the end of said discharge period.

9. The image display device according to claim 1, wherein said driving transistor is configured to be in a conductive state at the end of said discharge period.

* * * * *